US008251142B2

(12) United States Patent
Hinkie

(10) Patent No.: US 8,251,142 B2
(45) Date of Patent: Aug. 28, 2012

(54) SUPER SHOE SWELL PACKER

(75) Inventor: Ronald L. Hinkie, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 260 days.

(21) Appl. No.: 12/716,152

(22) Filed: Mar. 2, 2010

(65) Prior Publication Data

US 2011/0214863 A1 Sep. 8, 2011

(51) Int. Cl.
*E21B 23/10* (2006.01)
*E21B 33/12* (2006.01)

(52) U.S. Cl. ..... 166/285; 166/291; 166/192

(58) Field of Classification Search ..... 166/285, 166/291, 135, 192, 193
See application file for complete search history.

(56) References Cited

U.S. PATENT DOCUMENTS

| | | | | |
|---|---|---|---|---|
| 3,934,652 | A * | 1/1976 | Cochran | 166/285 |
| 5,058,672 | A * | 10/1991 | Cochran | 166/124 |
| 7,096,949 | B2 * | 8/2006 | Weber et al. | 166/291 |
| 7,665,538 | B2 * | 2/2010 | Robisson et al. | 166/387 |
| 7,861,781 | B2 * | 1/2011 | D'Arcy | 166/291 |

* cited by examiner

*Primary Examiner* — William P Neuder
(74) *Attorney, Agent, or Firm* — John W. Wustenberg; Baker Botts, LLP

(57) ABSTRACT

System and methods for effectively and efficiently cementing a casing annulus are disclosed. A packer system includes an outer case, a landing collar within the outer case and a slidable shifting sleeve coupled to the landing collar. The landing collar and the shifting sleeve are movable. A connecter coupled to the shifting sleeve and is movable in a movement slot with the shifting sleeve. A rubber element is coupled at one end to the connector and is on an outside surface of the outer case. The displacement of the connector in the movement slot compresses the rubber element.

17 Claims, 6 Drawing Sheets

SUPER SHOE SWELL PACKER

BACKGROUND

This invention relates to cementing operations in subterranean formations. In particular, this invention relates to system and methods for effectively and efficiently cementing a casing annulus.

It is common in the oil and gas industry to cement casing in well bores. Generally, a well bore is drilled and a casing string is inserted into the well bore. Drilling mud and/or a circulation fluid is circulated through the well bore by casing annulus and the casing inner diameter to flush excess debris from the well. As used herein, the term "circulation fluid"includes all well bore fluids typically found in a well bore prior to cementing a casing in the well bore. Cement composition is then pumped into the annulus between the casing and the well bore. The cement composition can keep the casing in position and prevent hydrocarbons or other fluids or gasses from flowing through the annulus.

In one method used to place the cement composition in the annulus, the cement composition slurry is pumped down the casing inner diameter, out through a casing shoe and/or circulation valve at the bottom of the casing and up through the annulus to its desired location. Once the cement is set, the operator may drill further down hole.

Typically, once the cement is placed in position the operator must give the cement some time to set before drilling further. Moreover, the stability of the cement column is often dependent on the formation properties with the cement giving way in weaker formation zones. Additionally, the cement may not set in place perfectly which may allow hydrocarbons or hydrostatic pressure to leak through the annulus into an area previously isolated by the cement. It is therefore desirable to provide an efficient and effective method of cementing in a subterranean formation.

FIGURES

Some specific example embodiments of the disclosure may be understood by referring, in part, to the following description and the accompanying drawings.

While embodiments of this disclosure have been depicted and described and are defined by reference to example embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

SUMMARY

This invention relates to cementing operations in subterranean formations. In particular, this invention relates to system and methods for effectively and efficiently cementing a casing annulus.

In one exemplary embodiment, the present invention is directed to a packer system comprising: an outer case; a landing collar within the outer case; a slidable shifting sleeve coupled to the landing collar; wherein the landing collar and the shifting sleeve are movable; a connecter coupled to the shifting sleeve; wherein the connecter is movable with the shifting sleeve; wherein the connector is movable in a movement slot; a rubber element coupled at one end to the connector; wherein the rubber element is on an outside surface of the outer case; wherein a displacement of the connector in the movement slot compresses the rubber element.

In another exemplary embodiment, the present invention is directed to a method of cementing a subterranean formation comprising: pumping cement through a casing; introducing a wiper plug in the casing; wherein the wiper plug pushes the cement through the casing; landing the wiper plug on a landing collar; wherein the landing collar is coupled to a shifting sleeve; wherein the shifting sleeve is operable to compress a rubber element; applying pressure to the landing collar; and compressing the rubber element.

The features and advantages of the present disclosure will be readily apparent to those skilled in the art upon a reading of the description of exemplary embodiments, which follows.

DESCRIPTION

This invention relates to cementing operations in subterranean formations. In particular, this invention relates to system and methods for effectively and efficiently cementing a casing annulus.

Figure 1:
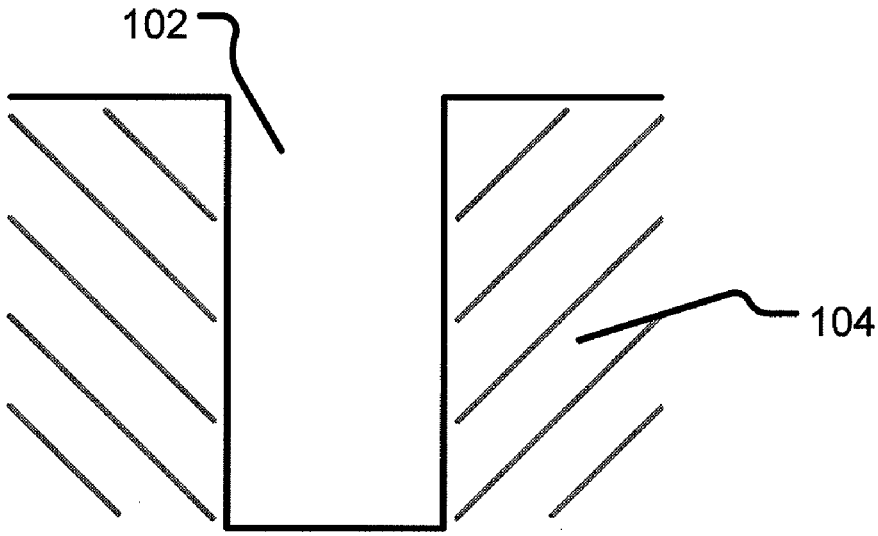
FIGS. 1-4 depict the steps for performing a cementing operation in a subterranean formation.
Figure 2:
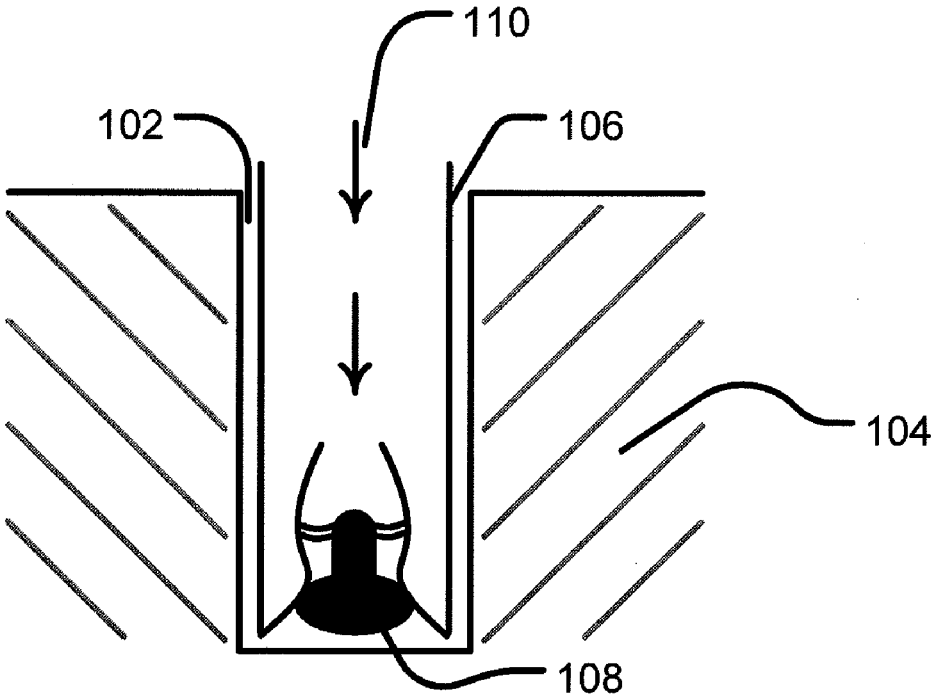
Figure 3:
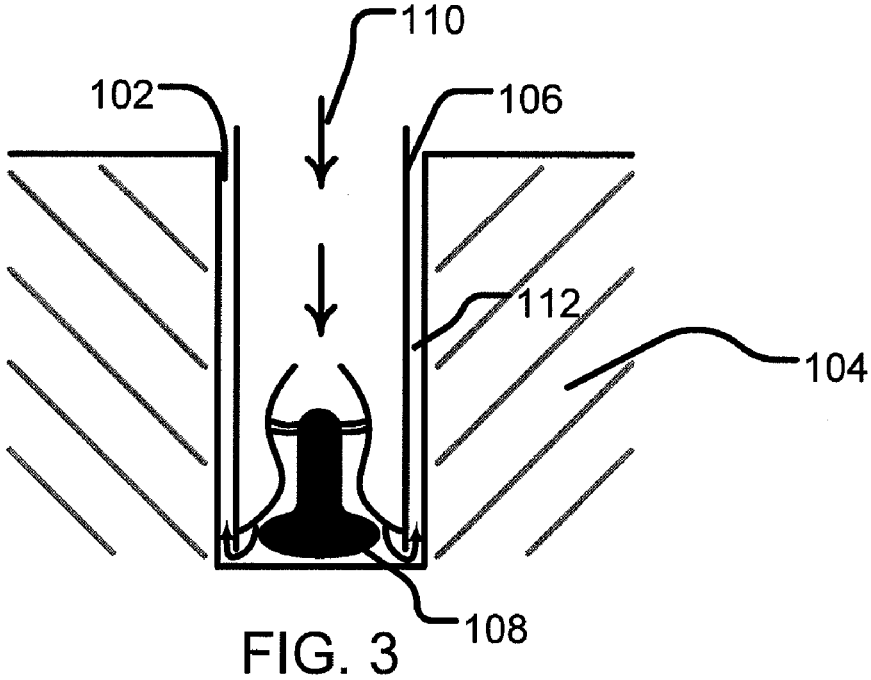
Figure 4:
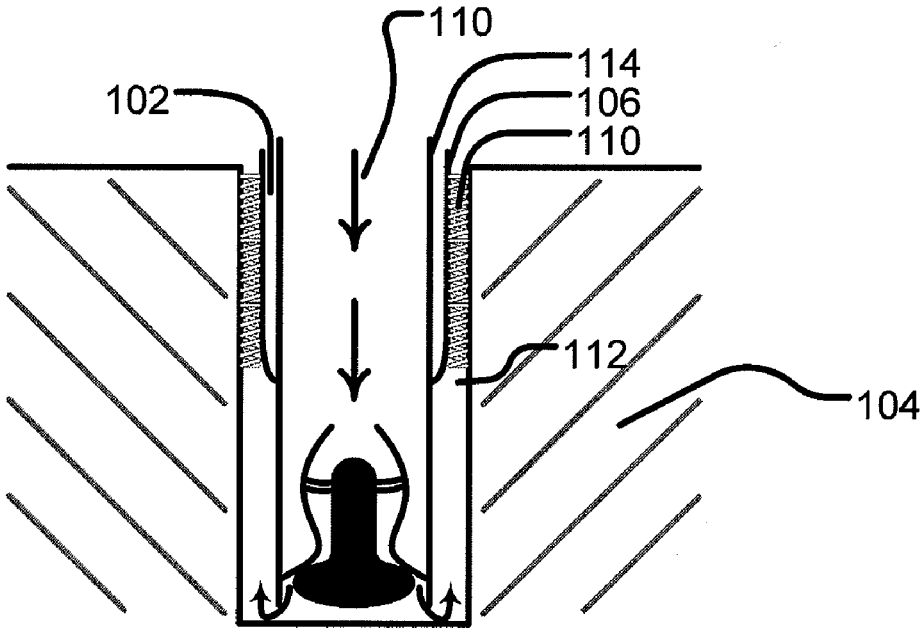
Figure 5:
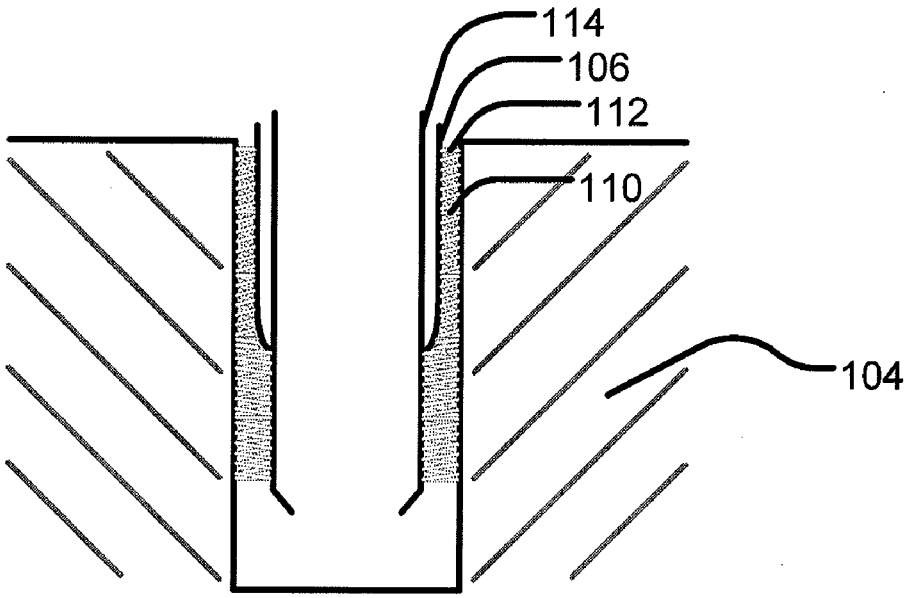
FIG. 5 depicts a subterranean formation after a cementing operation in accordance with the prior art.

Turning now to the figures, FIGS. 1-4 depict the steps that may be carried out during cementing in subterranean operations. As would be apparent to those of ordinary skill in the art, a number of additional components may be used in conjunction with the various steps depicted in FIGS. 1-4 but have been omitted to simplify the drawings. First, as depicted in FIG. 1, a well bore 102 may be drilled in a subterranean formation 104. Next, as depicted in FIG. 2, a casing string 106 may be lowered into the well bore 102. The casing string 104 may include a valve 108 at its lower end. Once the casing string 106 is lowered into the well bore 102, cement 110 may be pumped down through the casing string 106. As shown in FIG. 3, the cement 110 flows through the casing string 106, displaces the valve 108 and flows up through the annulus 112 in the well bore 102. As depicted in FIG. 4, once the casing string 106 is cemented in position, another casing string 114 having a smaller diameter may be passed through the first casing string 106 and the same process may be repeated to cement the various portions of the casing string, until a desired depth in the well bore 102 is reached. As depicted in FIG. 5, in typical subterranean operations, once a desired depth is reached, the cement will hold the casing string 106, 114 in place and control the pressure from the hydrocarbons through the annulus 112.

Figure 6:
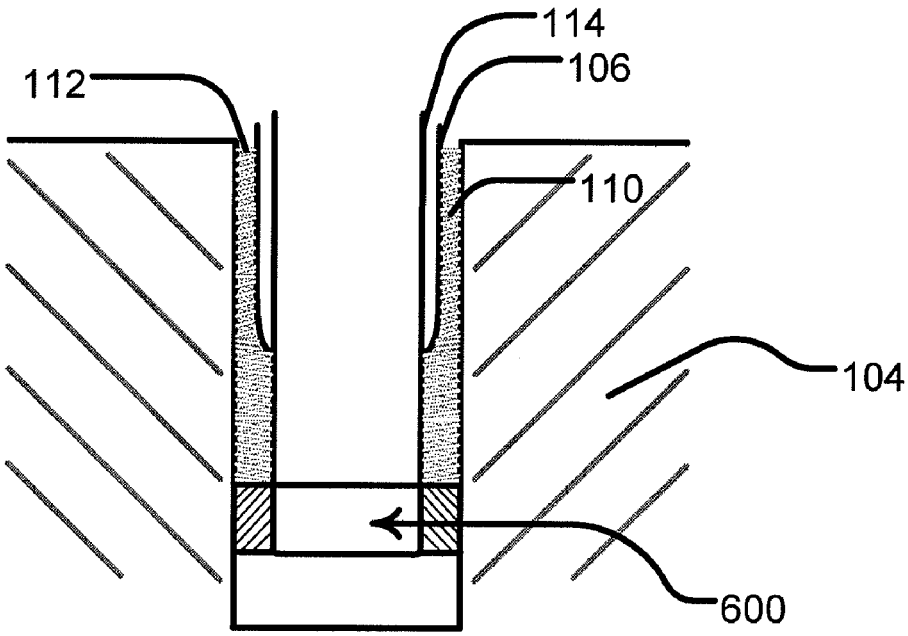
FIG. 6 depicts a subterranean formation after a cementing operation in accordance with an embodiment of the present invention.

Turning now to FIG. 6, in accordance with an embodiment of the present invention, the casing string 114 may be equipped with a swell packer 600. As would be appreciated by those of ordinary skill in the art, with the benefit of this disclosure, the swell packer 600 may be placed on any portion of the casing string. For example, in another exemplary embodiment, the swell packer 600 may be placed on the first portion of the casing string 106. Moreover, as would be apparent to those of ordinary skill in the art, with the benefit of this disclosure, in one exemplary embodiment multiple swell packers 600 may be used on different locations along the casing string. In one embodiment, a wiper plug (not shown) may be used at the end of a cement job to push any cement remaining in the casing string out into the annulus 112.

Figure 7:
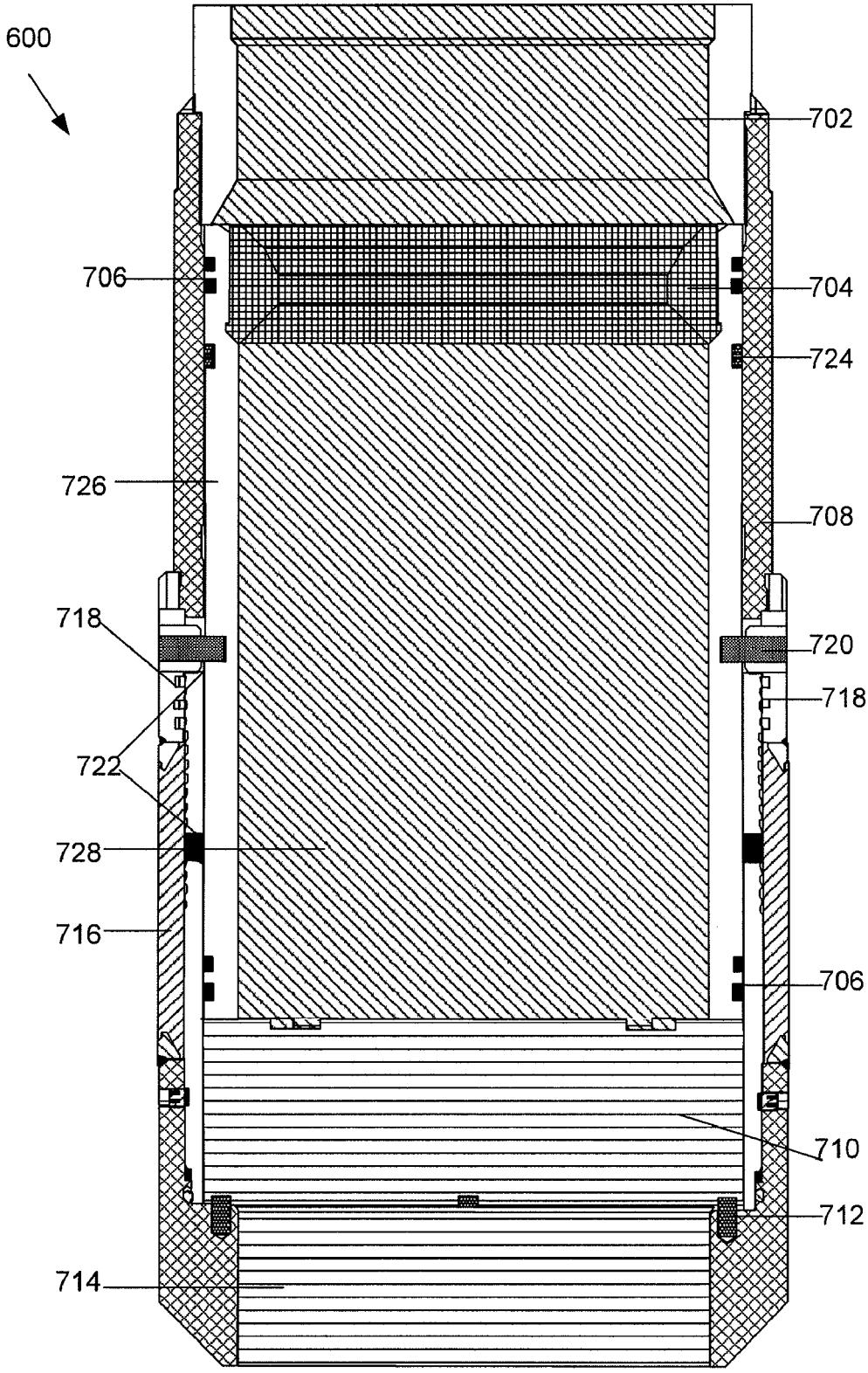
FIG. 7 is a swell packer in accordance with an exemplary embodiment of the present invention in the pre-compression state.
Figure 8:
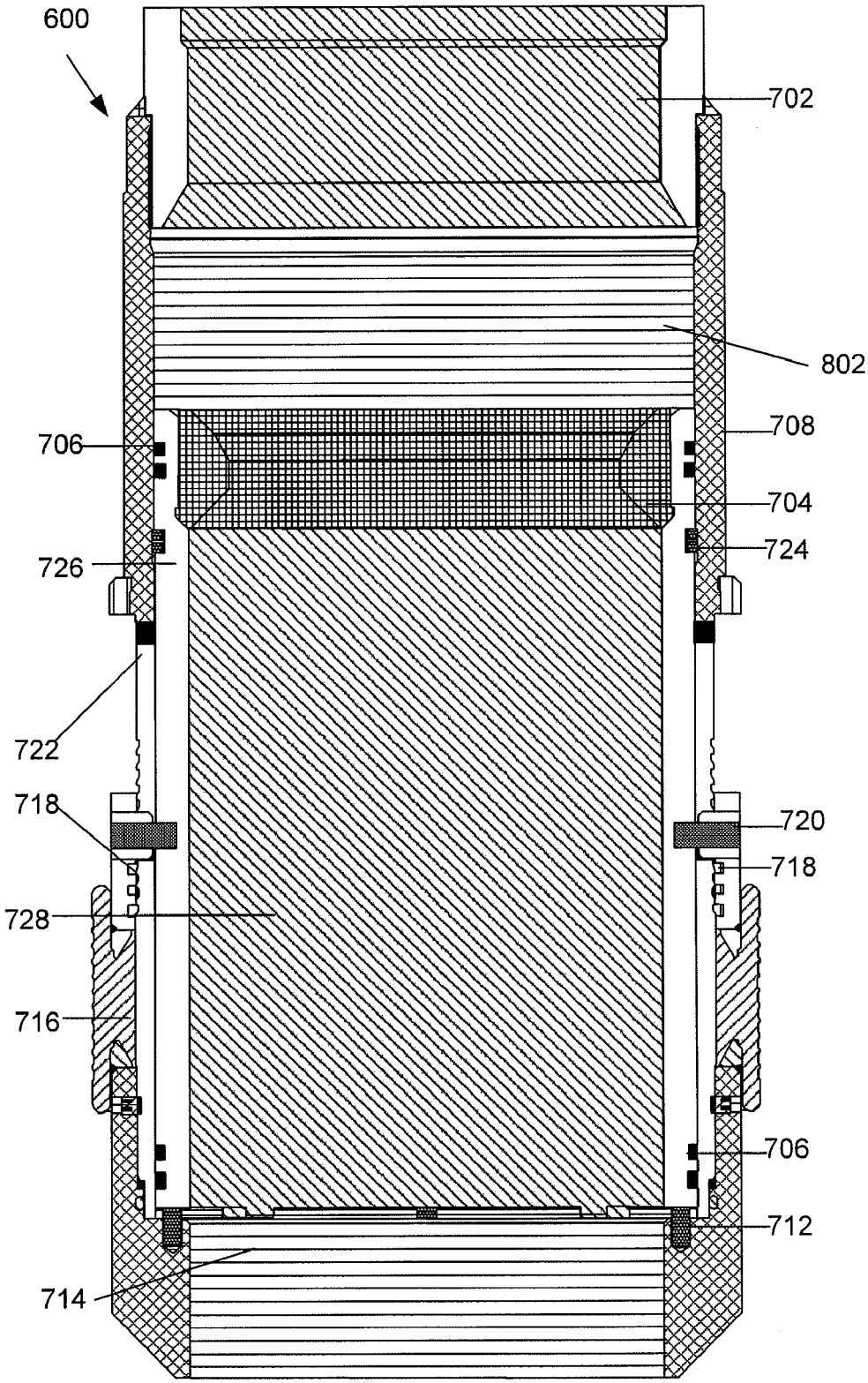
FIG. 8 is a swell packer in accordance with an exemplary embodiment of the present invention in the post-compression state.

FIGS. 7 and 8 depict the operation of a swell packer 600 in accordance with an embodiment of the present invention in more detail. Turning first to FIG. 7, a swell packer 600 in accordance with an embodiment of the present invention is depicted in the pre-compression state. The swell packer 600 includes a top thread 702 which couples the swell packer 600 to the casing string (not shown). Below the top thread is the landing collar 704. Seals 706 may be placed around the landing collar 704 and the lower portion of the swell packer 600. In one embodiment, the seal may be an O-ring seal. The swell packer 600 further includes an outer case 708. A lower sealing area 710 is positioned at a lower end of the swell packer 600 resting on stop pins 712 and a lower adapter 714. A rubber element 716 is placed on the outside surface of a portion of the outer case 708 and may be operable as a compression and swellable packer. In one embodiment, the rubber element 716 may include a metallic inner core such as, for example, stainless steel inner core (not shown). As depicted in FIG. 7, when in the pre-compression state, the rubber element 716 is in a stretched position and is coupled to shear pins 718 held in place by a force connector 720. The shear pins 718 shear under force and the force connector 720 may be moved down on the outer case 708 in a movement slot 722. In one embodiment, the swell packer 600 may further include a locking pin 724. The locking pin 724 may hold the compressed swell packer 600 in place (compressed) when force (pressure) is applied to either end. A shifting sleeve 726 is provided in the inside diameter of the apparatus inside the outer case 708 of the swell packer 600.

The operation of the swell packer 600 will now be disclosed in conjunction with FIGS. 7 and 8. At the end of a cement job, a wiper plug may be used to wipe clean the inside of the casing string. Once the wiper plug makes its way through the casing string, it lands on the landing collar 704. This would typically be the end of the cementing job. However, in accordance with an embodiment of the present invention, after the wiper plug has landed on the landing collar 704, the operator may continue to apply pressure to the wiper plug, pushing down the wiper plug and the landing collar 704. Specifically, as shown in FIG. 8, the wiper plug pushes onto the landing collar 704.

Figure 9:
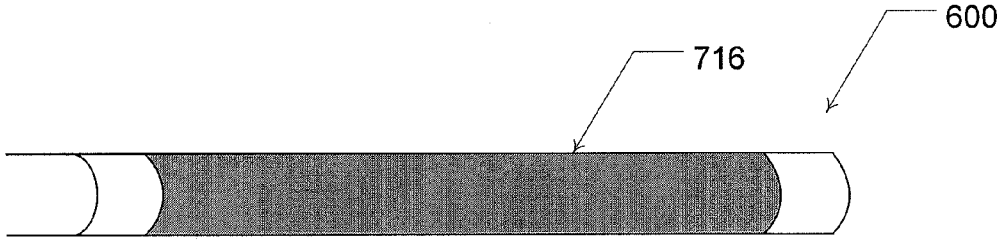
FIG. 9 is a perspective view of a swell packer in accordance with an exemplary embodiment of the present invention in the pre-compression state.
Figure 10:
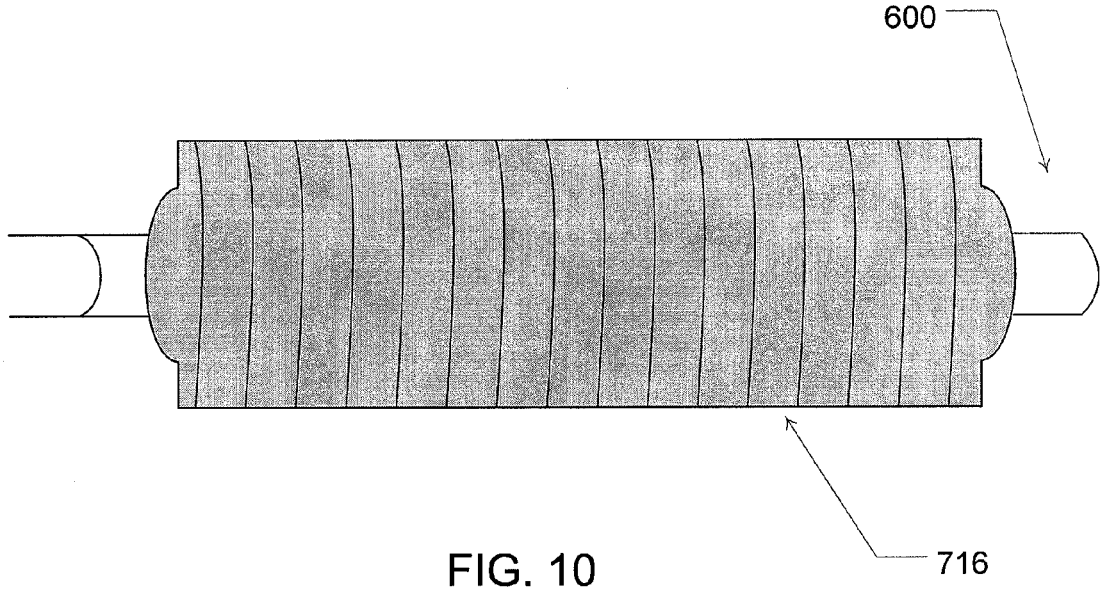
FIG. 10 is a perspective view of a swell packer in accordance with an exemplary embodiment of the present invention in the post-compression state.

As the landing collar 704 moves down, it also moves down the shifting sleeve 726 which in turn shears the shear pins 718 and moves the force connector 720 in the movement slot 722. The stop pins 712 provide a lower limit on how far down the landing collar 704 and the shifting sleeve 726 may be pushed. The displacement of the force connector 720 compresses the rubber element 716 as depicted in FIG. 8. In one embodiment, the inner stainless steel core of the rubber element 716 bends in a manner similar to an accordion with the applied pressure, further strengthening the compressed rubber element 716. As would be appreciated by those of ordinary skill in the art, with the benefit of this disclosure, the rubber element may include materials that swell after compression, further improving the seal created between the swell packer 600 and the well bore (not shown). For example, in one embodiment, the rubber element 716 may be a swellable rubber material that swells when it comes in contact with hydrocarbons, water or other fluids. Accordingly, the swell packer 600 quickly provides an effective and efficient seal with the well bore, providing a lower boundary for the cement column in the annulus. FIGS. 9 and 10 depict a perspective view of a swell packer 600 in accordance with an embodiment of the present invention in the precompressed and compressed state respectively.

Therefore, the present invention is well-adapted to carry out the objects and attain the ends and advantages mentioned as well as those which are inherent therein. While the invention has been depicted and described by reference to exemplary embodiments of the invention, such a reference does not imply a limitation on the invention, and no such limitation is to be inferred. The invention is capable of considerable modification, alteration, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects. The teems in the claims have their plain, ordinary meaning unless otherwise explicitly and clearly defined by the patentee.

What is claimed is:

1. A packer system comprising:
an outer case;
a landing collar within the outer case;
a slidable shifting sleeve coupled to the landing collar;
wherein the landing collar and the shifting sleeve are movable;
a connecter coupled to the shifting sleeve;
wherein the connecter is movable with the shifting sleeve;
wherein the connector is movable in a movement slot;
a rubber element coupled at one end to the connector;
wherein the rubber element is on an outside surface of the outer case;
wherein a displacement of the connector in the movement slot compresses the rubber element.

2. The packer system of claim 1, wherein the rubber element is compressible.

3. The packer system of claim 1, wherein the rubber element is swellable.

4. The packer system of claim 3, wherein the rubber element swells when it comes in contact with a material selected from the group consisting of water and a hydrocarbon.

5. The packer system of claim 1, wherein the rubber element comprises an imbedded sleeve.

6. The packer system of claim 5, wherein the imbedded sleeve is metallic.

7. The packer system of claim 5, wherein the imbedded sleeve is stainless steel.

8. The packer system of claim 1, further comprising a locking pin; wherein the locking pin keeps the compressed rubber element in place.

9. The packer system of claim 1, wherein the slidable shifting sleeve and the landing collar are sealed.

10. A method of cementing a subterranean formation comprising:
pumping cement through a casing;
introducing a wiper plug in the casing;
wherein the wiper plug pushes the cement through the casing;
landing the wiper plug on a landing collar;

wherein the landing collar is located within an outer case;

wherein the landing collar is coupled to a slidable shifting sleeve;

wherein the shifting sleeve is coupled to a connector movable in a movement slot;

wherein the shifting sleeve is operable to compress a rubber element on an outside surface of the outer case;

wherein a displacement of the connector in the movement slot compresses the rubber element;

applying pressure to the landing collar; and compressing the rubber element.

11. The method of claim 10, further comprising swelling the rubber element.

12. The method of claim 11, wherein swelling the rubber element comprises bringing the rubber element in contact with a fluid.

13. The method of claim 12, wherein the fluid is selected from the group consisting of water and a hydrocarbon.

14. The method of claim 10, wherein the rubber element comprises an inside sleeve.

15. The method of claim 14, wherein the inside sleeve is metallic.

16. The method of claim 10, wherein the shifting sleeve is coupled to the rubber element through a force connector.

17. A method of cementing a subterranean formation comprising:

pumping cement through a casing;

introducing a wiper plug in the casing;

wherein the wiper plug pushes the cement through the casing;

landing the wiper plug on a landing collar;

wherein the landing collar is coupled to a shifting sleeve;

wherein the shifting sleeve is operable to compress a rubber element;

applying pressure to the landing collar; and compressing the rubber element, wherein the shifting sleeve is coupled to the rubber element through a force connector;

wherein compressing the rubber element comprises moving the landing collar down, wherein the landing collar moves the shifting sleeve down;

wherein the shifting sleeve moves the force connector; and wherein the movement of the force connector compresses the rubber element.

* * * * *